US008201756B2

(12) United States Patent
Hornsby et al.

(10) Patent No.: US 8,201,756 B2
(45) Date of Patent: Jun. 19, 2012

(54) PUMP-DRIVEN FLUID SPRAYER AND METHOD

(75) Inventors: James Russell Hornsby, St. Louis, MO (US); Joseph Lee McGowan, St. Charles, MO (US); Marcellus Rambo Benson, Chesterfield, MO (US); James Augustus Keefe, III, O'Fallon, MO (US)

(73) Assignee: S.C. Johnson & Son, Inc., Racine, WI (US)

( * ) Notice: Subject to any disclaimer, the term of this patent is extended or adjusted under 35 U.S.C. 154(b) by 515 days.

(21) Appl. No.: 12/227,478

(22) PCT Filed: May 18, 2007

(86) PCT No.: PCT/US2007/069270

§ 371 (c)(1),
(2), (4) Date: May 18, 2009

(87) PCT Pub. No.: WO2007/137176

PCT Pub. Date: Nov. 29, 2007

(65) Prior Publication Data

US 2010/0006591 A1 Jan. 14, 2010

Related U.S. Application Data

(60) Provisional application No. 60/801,909, filed on May 19, 2006.

(51) Int. Cl.
*B65D 1/32* (2006.01)

(52) U.S. Cl. ..... 239/327; 239/328; 239/332; 239/373; 239/337; 239/289; 222/92

(58) Field of Classification Search ..... 239/289, 239/327, 328, 332, 337, 373; 222/92, 175
See application file for complete search history.

(56) References Cited

U.S. PATENT DOCUMENTS 4,272,019 A 6/1981 Halaby, Jr.

(Continued)

FOREIGN PATENT DOCUMENTS

WO WO 2005/023679 A1 3/2005

OTHER PUBLICATIONS

International Search Report and Written Opinion for PCT/US07/69270.

*Primary Examiner* — Dinh Q Nguyen

(57) ABSTRACT

A fluid delivery device including a fluid reservoir, a pump in fluid communication with the reservoir, an electric motor, a bladder in fluid communication with the pump, the bladder including at least in part, an elastic portion, a nozzle valve in fluid communication with the bladder, the nozzle being adjustable from an open mode to a closed mode, and from a closed mode to an open mode, a pressure release valve in fluid communication with the bladder and the fluid reservoir; and an electronic control unit for controlling delivery of the fluid. The invention also encompasses a method of delivering a treating fluid in a fine mist, including powering-up a fluid delivery device, comparing a signal being received from an ambient light sensor to predetermined trigger values consistent with dusk and dawn ambient light conditions, and dispensing treating fluid for a selected duration period on the basis of the signal being received from the ambient light sensor.

15 Claims, 4 Drawing Sheets

U.S. PATENT DOCUMENTS 5,183,185 A 2/1993 Hutcheson et al.
5,535,951 A * 7/1996 Utter ..... 239/322
5,622,056 A 4/1997 Utter
5,758,800 A 6/1998 D'Andrade
5,772,074 A * 6/1998 Dial et al. ..... 222/1
5,799,827 A 9/1998 D'Andrade
5,906,295 A 5/1999 D'Andrade
5,964,403 A * 10/1999 Miller et al. ..... 239/1
6,158,669 A * 12/2000 Louis ..... 239/146
6,167,925 B1 1/2001 D'Andrade et al.
6,193,107 B1 2/2001 D'Andrade
6,267,297 B1 7/2001 Contadini et al.
6,347,414 B2 2/2002 Contadini et al.
6,364,219 B1 4/2002 Zimmerman et al.
6,394,310 B1 5/2002 Muderlak et al.
6,554,203 B2 4/2003 Hess et al.
6,739,479 B2 5/2004 Contadini et al.
6,769,580 B2 8/2004 Muderlak et al.
6,820,821 B2 11/2004 Linstedt et al.
6,981,613 B1 * 1/2006 Kamisugi ..... 222/105
6,997,399 B2 * 2/2006 Lacy ..... 239/373
7,021,494 B2 4/2006 Mazooji et al.
7,118,050 B1 * 10/2006 Chen ..... 239/328
2006/0000854 A1 1/2006 Hornsby et al.
2006/0191955 A1 8/2006 McLisky
2007/0241259 A1 10/2007 Pandorf et al.

* cited by examiner

PUMP-DRIVEN FLUID SPRAYER AND METHOD

CROSS-REFERENCE TO RELATED APPLICATION(S)

This application claims priority to U.S. Provisional Application No. 60/801,909, filed on May 19, 2006.

BACKGROUND

The present invention relates to devices for delivering, dispensing, or dispersing substances, and to methods of making and using such devices. More particularly, it relates to a device for delivering and/or dispersing a product, such as an insecticide, wherein the device produces a fine spray or mist of the product.

Very fine misting or atomization of liquids, currently, may be achieved through use of aerosol devices. Aerosol devices, however, exhibit several drawbacks. For example, such delivery devices typically utilize pressurized containers which must be handled carefully and at controlled temperatures to avoid the risk of explosion. Additionally, such spray devices employ propellants which affect the ozone and are relatively expensive.

Accordingly, there is a need in the art for a device that allows for the production of a liquid mist having droplet sizes in the range of those produced by an aerosol device, but does not employ an aerosol type delivery method.

SUMMARY

The present invention, in one embodiment, is a fluid delivery device comprising a fluid reservoir, a pump in fluid communication with the reservoir, an electric motor, a bladder in fluid communication with the pump, the bladder comprising at least in part, an elastic portion, a nozzle valve in fluid communication with the bladder, the nozzle being adjustable from an open mode to a closed mode, and from a closed mode to an open mode, a pressure release valve in fluid communication with the bladder and the fluid reservoir; and an electronic control unit for controlling delivery of the fluid.

In some embodiments, the fluid delivery device delivers the fluid in a fine mist, the fine mist comprising a plurality of droplets having a diameter of less than about 50 microns. In further embodiments, the fluid to be delivered comprises a diluted aqueous solution of at least one of an insecticide, pesticide, or fungicide.

In accordance with another aspect, the nozzle comprises a rotatable valve member for adjusting the nozzle from the open mode to the closed mode, and from the closed mode to the open mode. In a further embodiment, the rotatable valve member is operatively connected to an electric motor.

The present invention, in another embodiment, is a fluid delivery device comprising a fluid reservoir, a means for pumping the fluid, the pumping means being in fluid communication with the reservoir, an electric motor, a bladder in fluid communication with the pumping means, the bladder comprising at least in part, an elastic portion, a nozzle valve in fluid communication with the bladder, the nozzle being adjustable from an open mode to a closed mode, and from a closed mode to an open mode, a pressure release valve in fluid communication with the bladder and the fluid reservoir; and an electronic control unit for controlling delivery of the fluid.

Additionally, the invention encompasses a method of delivering a treating fluid in a fine mist comprising powering a fluid delivery device, comparing a signal being received from an ambient light sensor to predetermined trigger values consistent with dusk and dawn ambient light conditions, and dispensing treating fluid from the device for a selected duration period on the basis of the signal being received from the ambient light sensor.

While multiple embodiments are disclosed, still other embodiments of the present invention will become apparent to those skilled in the art from the following detailed description, which shows and describes illustrative embodiments of the invention. As will be realized, the invention is capable of modification without departing from the spirit and scope of the present invention. Accordingly, the drawings and detailed description are to be regarded as illustrative in nature and not restrictive.

DETAILED DESCRIPTION

Figure 1:
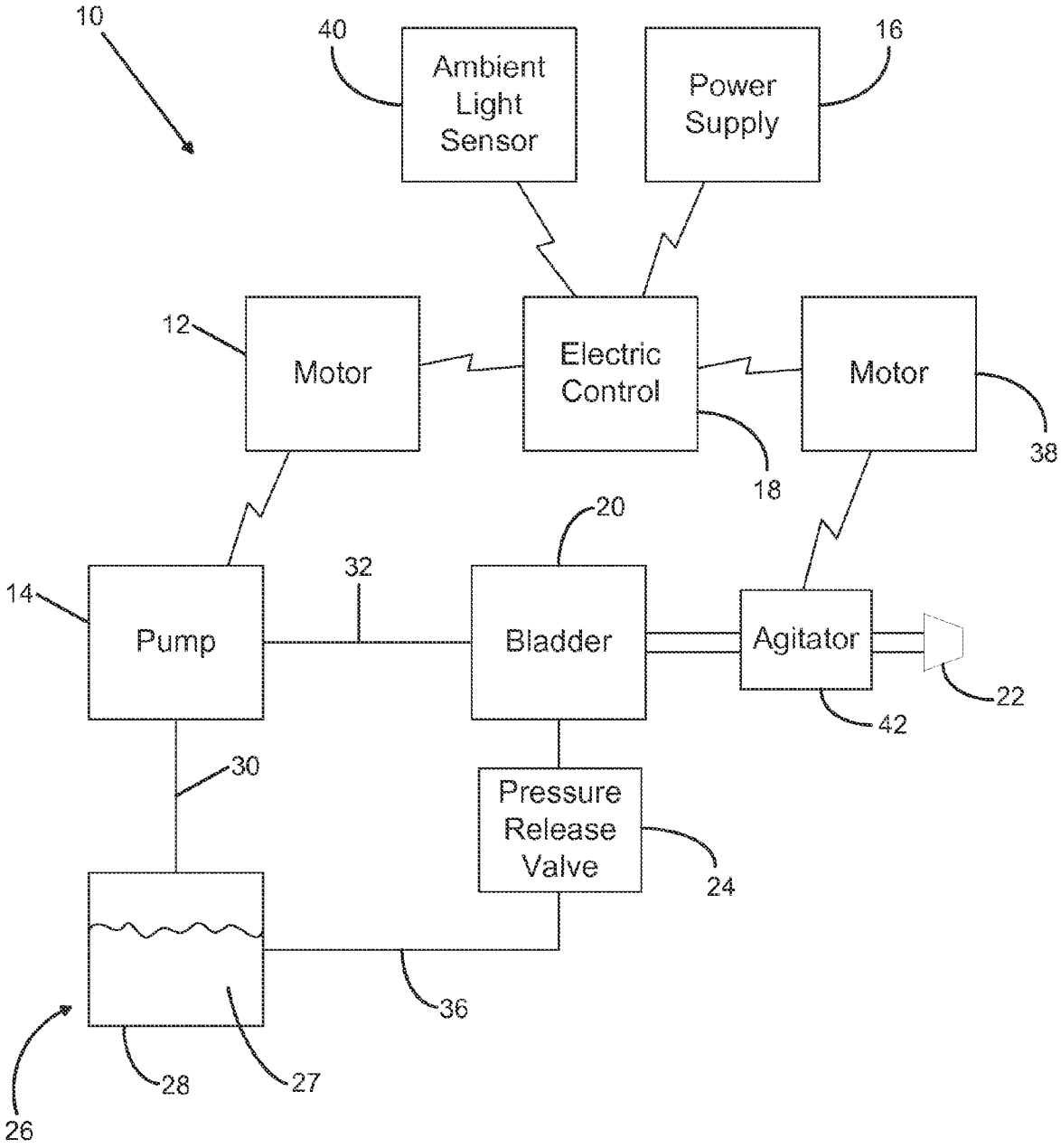
FIG. 1 is a schematic view of a fluid delivery device in accordance with one embodiment.

Referring to FIG. 1, one exemplary embodiment of a pump-driven fluid sprayer device 10 designed to function for home pest or insect control is shown. In other embodiments, the device 10 may be adapted for other applications including, but not limited to air treatment systems, sanitation systems, cooling systems, or any other systems that may require or incorporate a liquid based substance or formula to be sprayed, dispensed, or disbursed in a fine mist. In the embodiment of FIG. 1, the device 10 comprises a motor 12, pumping mechanism 14, power supply 16, electronic control unit 18, bladder 20, spray nozzle 22, safety pressure valve 24, and fluid source 26.

In some embodiments, the fluid source 26 comprises a reservoir 28 containing a liquid treating fluid 27, which can be withdrawn from reservoir 28 through conduit 30 by pumping mechanism 14. In a particular embodiment, reservoir 28 is simply a container for liquid treating fluid 27, which may, for example, be a diluted aqueous solution of an appropriate insecticide, pesticide, fungicide, or the like. Generally, the reservoir 28 will have a capacity appropriate for the desired application of the device. In one embodiment, the reservoir 28 may have a capacity ranging between about 2 oz. and 12 gallons. In a further embodiment, the reservoir may have a capacity of about 6 oz.

In one embodiment, the pumping mechanism 14 comprises a piston-type pump. In some embodiments, the pumping mechanism 14, and related peripheral features, including without limitation, conduits, connectors, and valves comprise a piston-type pump of the type disclosed in published U.S. Pat. App. No. 20050133627, which is herein incorporated by reference. Alternatively, those skilled in the art will readily understand that a gear pump or other suitable pumping mechanism may comprise the pumping mechanism 14 without departing from the spirit of the invention.

In some embodiments, pumping mechanism 14 is operatively connected to and driven by a motor 12. For example, in one embodiment, the motor 12 comprises a 13,000 RPM/6V gear driven electronic motor. In a further embodiment, motor 12 comprises an electronic motor of the type disclosed in published U.S. Pat. App. No. 20050133627, which is herein incorporated by reference. When activated, pumping mechanism 14 discharges the treating fluid 27 into conduit 32, which feeds the treating fluid 27 to a bladder 20.

In an embodiment, bladder 20 comprises an at least partially flexible container which is positioned such that it can expand as it is filled with treating fluid 27 to substantially fill bladder 20. Bladder 20 may be formed, in whole or in part, by any material with elastic properties, such as for example, rubber. In certain embodiments, the flexibility may be provided by the bladder as a whole such that all of the walls which comprise the bladder 20 are uniformly flexible. In an alternative embodiment, however, the bladder 20 may comprise one or more rigid walls with a flexible portion, such as for example, a flexible membrane set in a wall.

In some embodiments, flow of treating fluid 27 out of the bladder 20 may be controlled by one or more nozzle valves 22 coupled to the bladder 20. Each of the one or more nozzle valves 22 comprises an open mode and a closed mode. Mode adjustment may be achieved for example, by actuation of a valve member. In one embodiment, mode adjustment is achieved by coupling a rotatable valve member to each of the one or more nozzle valves 22, such that when rotated, the rotatable valve member switches the one or more nozzle valves 22 between the closed mode and the open mode, or between the open mode and the closed mode. For example, in one embodiment, when the rotatable valve member is rotated 90 degrees, the one or more nozzle valves 22 are switched between the closed mode and the open mode, or between the open mode and the closed mode. Alternatively, the mode adjustment of the one or more nozzle valves 22 may be achieved by any known method in the art. The nozzle valve 22, in the open mode, releases the pressurized treating fluid 27 to the surrounding environment.

In some embodiments, the one or more nozzle valves 22 are comprised of a metal such as stainless steel or brass, or a suitable polymeric materially that is chemically resistant to the composition of the treating fluid 27 and that is able to withstand pressures within the intended operating ranges. Generally, the flow rate through each nozzle will be an appropriate rate for the desired application of the device 10. In one embodiment, the flow rate through each nozzle may range between about 0.5 oz./min and 12 gallons/min, although it will be appreciated that both higher and lower flow rates can be used effectively in the operation of device 10.

In one embodiment, the motor 12 is also operatively connected to each of the one or more nozzle valves 22 such that when activated, motor 12 causes the valves to be adjusted from the open mode to the closed mode, or from the closed mode to the open mode. For example, in a specific embodiment, the motor 12 may be operated in a first direction to drive the pumping mechanism 14, and a second direction to actuate the one or more nozzle valves 22. In an alternative embodiment, however, each of the pumping mechanism 14 and one or more nozzle valves 22 may be driven/actuated by a separate motor 38.

Additionally, the one or more nozzle valves 22, in one embodiment, are adapted to dispense or direct the treating fluid 27 in a selected direction. For example, in a specific embodiment, the one or more nozzle valves 22 are rotatably and/or pivotably coupled to the bladder 20.

In an alternative embodiment, after exiting the bladder 20, the treating fluid 27 is additionally subjected to an agitator 42 which acts to further atomize the treating fluid 27. Agitator 42 may comprise any device which imparts energy to the treating fluid 27. For example, in one embodiment, the agitator 42 comprises a sonic or ultrasonic wave generator which is used to impart sonic or ultrasonic waves onto the treating fluid 27.

In a first stage of operation, typically, the one or more nozzle valves 22 are closed. With the nozzle valves closed, in the first stage, pumping mechanism 14 will initiate flow of the treating fluid 27 from the reservoir to the flexible bladder 20 via fluid conduits 30 and 32. Consequently, as treating fluid 27 is displaced to the bladder 20, the internal pressure within the bladder 20 increases. In some embodiments, after a selected internal bladder pressure is achieved, a second stage of operation, or delivery stage is commenced. For example, in one embodiment, the delivery stage is commenced at an internal bladder pressure of 50 psi. In the delivery stage, the device 10 will operate with the nozzle valve 22 in the open mode for a selected amount of time. At the end of the delivery stage, the nozzle valve 22 is returned to the closed mode.

In certain embodiments, the system 10 comprises a pressure release valve 24 for bleeding off or releasing pressure, which is coupled to the bladder 20. The pressure release valve 24, in some aspects, comprises any valve which provides for one-directional flow of fluid after a maximum upstream pressure has been achieved. In a particular embodiment, the safety pressure release valve 24 comprises a check valve in the form of a check ball to permit flow of the treating fluid 27 after a predetermined maximum pressure has been achieved in the bladder 20. In one embodiment, the pressure release valve 24 permits flow at upstream pressures of greater than about 100 psi. Once the maximum pressure has been achieved, the safety pressure release valve 24 provides a fluid connection between the bladder 20 and the fluid reservoir 28 via conduit 36.

Conduits 30, 32, and 36 may comprise any suitable tubing material. Such tubing may comprise, for example, flexible polyethylene tubing, PVC pipe, or any other similarly effective material for the treating fluid to be dispensed.

In one embodiment, operation of the system 10 can be controlled and/or monitored by an electronic control unit 18. The electronic control unit 18 may comprise, for example, a programmable integrated circuit (IC) mounted on a printed circuit board (PCB) and an on/off actuator. In one embodiment, after the device 10 has been turned on by the actuator, the IC generates control signals for controlling the motor 12, which, in turn, drives the pumping mechanism 14 and the adjustment of the one or more nozzle valves 22 from the closed mode to the open mode and from the open mode to the closed mode.

Additionally, in some embodiments, the electronic control unit 18 may comprise a actuators, inputs, displays, indicators, and the like such that an operator may manually monitor and control operation of the device 10. For example, electronic control unit may comprise one or more actuators for controlling whether the pumping mechanism is on or off and/or whether the one or more nozzle valves 22 are in the open mode or closed mode. Additionally, for example, electronic unit 18 may comprise a plurality of indicators which provide an operator with a means for determining whether electrical power to the device 10 is on or off, whether the pumping mechanism 14 is on or off, and/or whether the one or more nozzle valves 22 are in the open mode or the closed mode.

In one embodiment, the device of the present invention comprises an ambient light sensor 40 in electronic which generates and feeds an electric signal to the electronic control unit 18. For example, in one embodiment, ambient light sensor 40 comprises a cadmium sulfide photocell. Ambient light sensor 40, in some embodiments, is positioned such that it is not blocked from receiving the prevailing ambient light by other components of the device 10.

Electrical power for the components of the device 10 is supplied by a power supply 16. In one embodiment, the power supply 16 comprises one or more batteries removably mounted in a battery holder with output terminals. While different sizes of batteries with different voltages may be used, in one embodiment, the batteries are type AA batteries. In an alternative embodiment, the power supply 16 for the device 10 comprises a 110V or 220V line current fed from a conventional outlet through a power cord.

In one embodiment, the device 10 may be received, mounted, or carried in or on an appropriate structure, housing, or enclosure. For example, in one embodiment, the device 10 may be received by a housing such that all of the components of the device 10, except the one or more nozzle valves 22, are disposed within the housing. The housing, in one embodiment, comprises an outdoor light source such as, for example, a lantern or tiki torch. Alternatively, in an embodiment, the device 10 may be permanently or semi-permanently mounted on buildings, walls, poles, fences, or other similar structures.

Figure 2A:
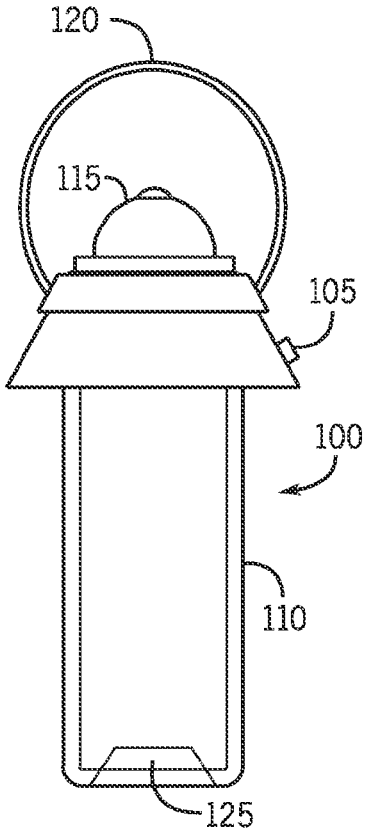
FIGS. 2*a*-2*d* depict embodiments of a fluid delivery device which is received by a housing.

An exemplary embodiment of a fluid delivery device being received by and/or carried in a housing is illustrated in FIGS. 2*a*-2*d*. Referring to FIG. 2*a*, a fluid delivery device 100 comprises a cap portion 105 and a reservoir 110. Coupled to the cap portion 105 are a rotatable spray nozzle 115 and handle 120. In one embodiment, rotatable spray nozzle 115 is coupled to the cap portion 105 such that it may be rotated 360 degrees. Additionally, in one embodiment, reservoir 110 comprises a recessed portion 125.

Figure 2B:
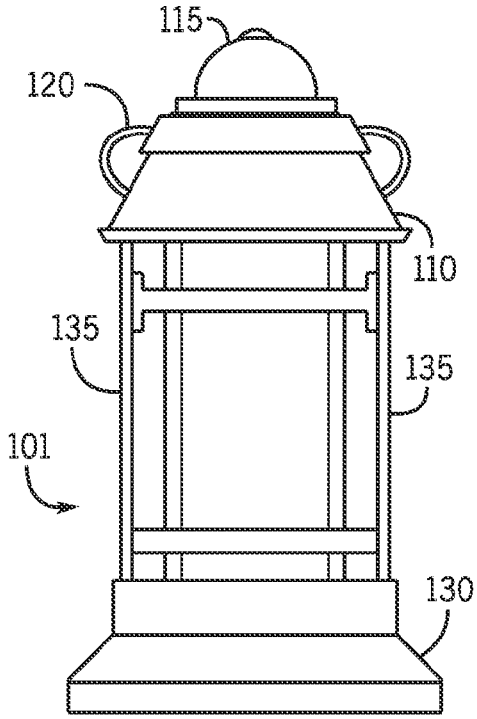

As shown in FIGS. 2*a*-2*b*, fluid delivery device 100 is received by a housing 101 which comprises a base 130 and a plurality of support members 135 extending axially from the base 130.

In some embodiments, the cap portion 105 may comprise one or more of the components of the fluid delivery device, including for example, motors, a pumping mechanism, a bladder, a power supply and an electronic control unit. Additionally, in some embodiments, the base 130 of the housing 101 may comprise one or more of the components of the fluid delivery device.

Figure 2C:
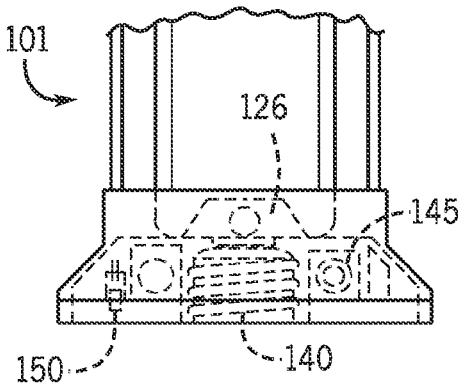
Figure 2D:
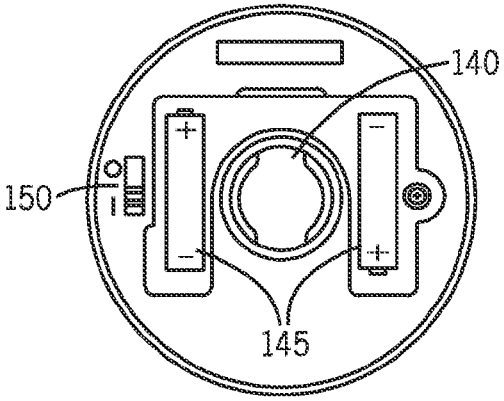

Referencing FIGS. 2*c*-2*d*, the base 130 comprises a light bulb 126, female threaded portion 140, power supply 145, and on/off actuator 150. As is shown with reference to FIG. 2*c*, light bulb 126 is positioned within the base 130 such that when the fluid delivery device 100 is received by the housing 101, the light bulb 126 is received by the recessed portion of the reservoir 125.

In some embodiments, the housing 101 may be mounted on an appropriate structure. For example, in one embodiment, the housing 101 may be mounted on any structure having a male threaded portion, such as for example, a pole or fence post.

The power supply for the device 100, in the embodiment of FIGS. 2*a*-2*d* comprises two AA batteries 145 removably mounted in a battery holder with output terminals. It will be appreciated, however, that different numbers and/or sizes of batteries may be employed. In an alternative embodiment, the power supply 145 for the device 10 may comprise a 110V or 220V line current fed from a conventional outlet through a power cord.

Figure 3:
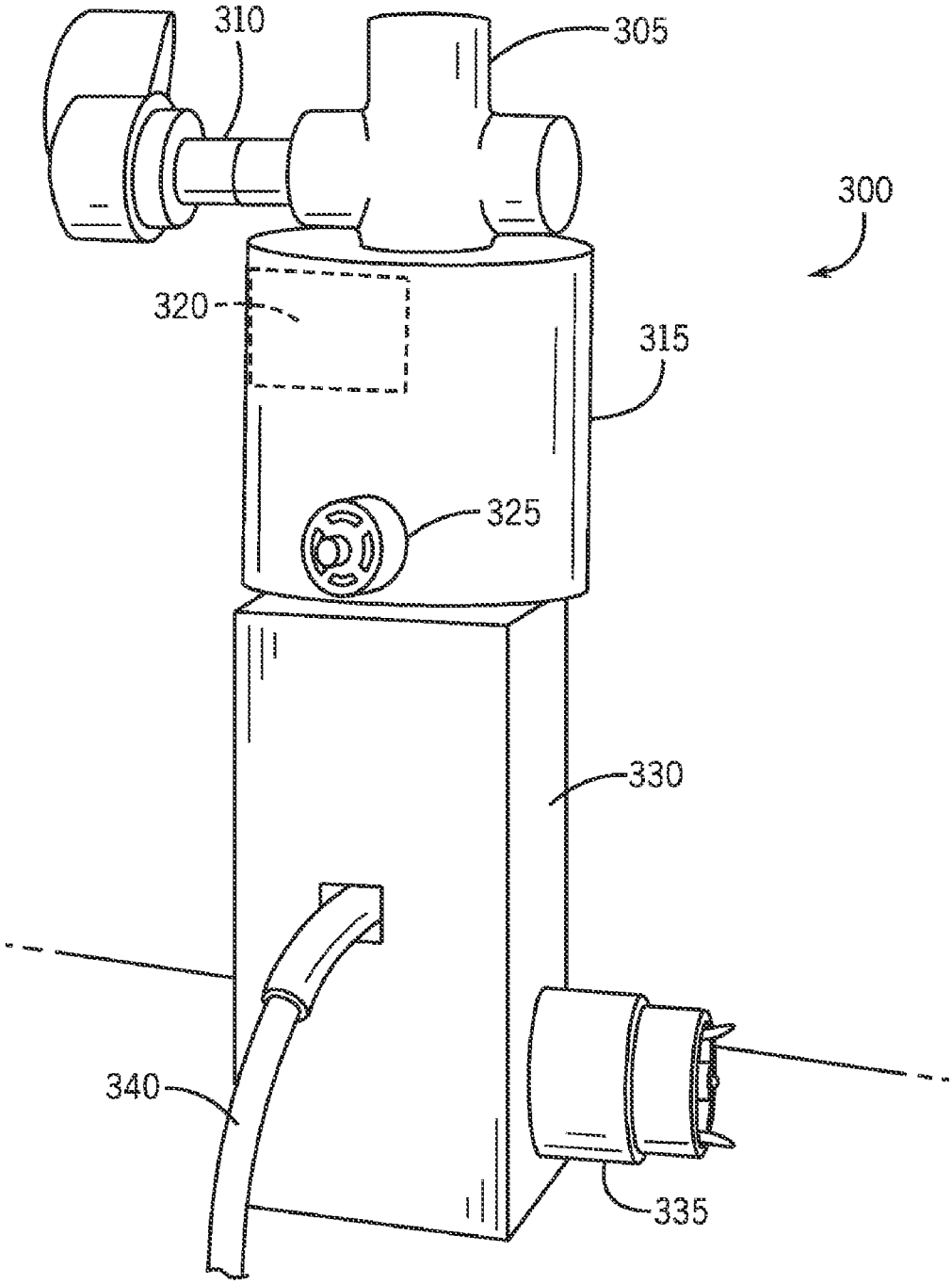
FIG. 3 is an illustration of a fluid delivery device in accordance with another embodiment.

Another exemplary embodiment of a fluid delivery device in accordance with the present invention is illustrated in FIG. 3. In the embodiment of FIG. 3, the device 300 comprises a spray nozzle 305, bladder 315, pressure release valve 325, base portion 330, motor 335, and power supply 340. As shown in FIG. 3, the bladder 325, motor 335, and power supply 340 are coupled to the base 330. Additionally, as shown, the pressure release valve 325 and spray nozzle 305 are coupled to the bladder 315.

In accordance with the embodiment of FIG. 3, one or more components of the device 300 may be housed within the base 330. For example, in the embodiment of FIG. 3, a fluid reservoir, a pumping mechanism, and an electronic control unit are housed within the base 330.

In some embodiments, the bladder 325 comprises a partially flexible container which is positioned such that it can expand as it is filled with treating fluid. In the embodiment of FIG. 3, the bladder 325 comprises a rigid wall with a flexible portion, the flexible membrane 320, set in the rigid wall.

Electrical power for the components of the device 300 is supplied by a power supply 340. In the embodiment of FIG. 3, the power supply 340 comprises a 110V or 220V line current fed from a conventional outlet through a power cord. Alternatively, power supply 340 may comprise one or more batteries removably mounted in a battery holder with output terminals.

In the embodiment of FIG. 3, flow of treating fluid out of the bladder 315 is controlled by nozzle valve 305, which is in fluid communication with the bladder 315. The nozzle valve 305 comprises a rotatable valve member 310. The rotatable valve member 310, when rotated, switches the nozzle valve 305 between a closed mode and an open mode, or between an open mode and a closed mode.

Figure 4:
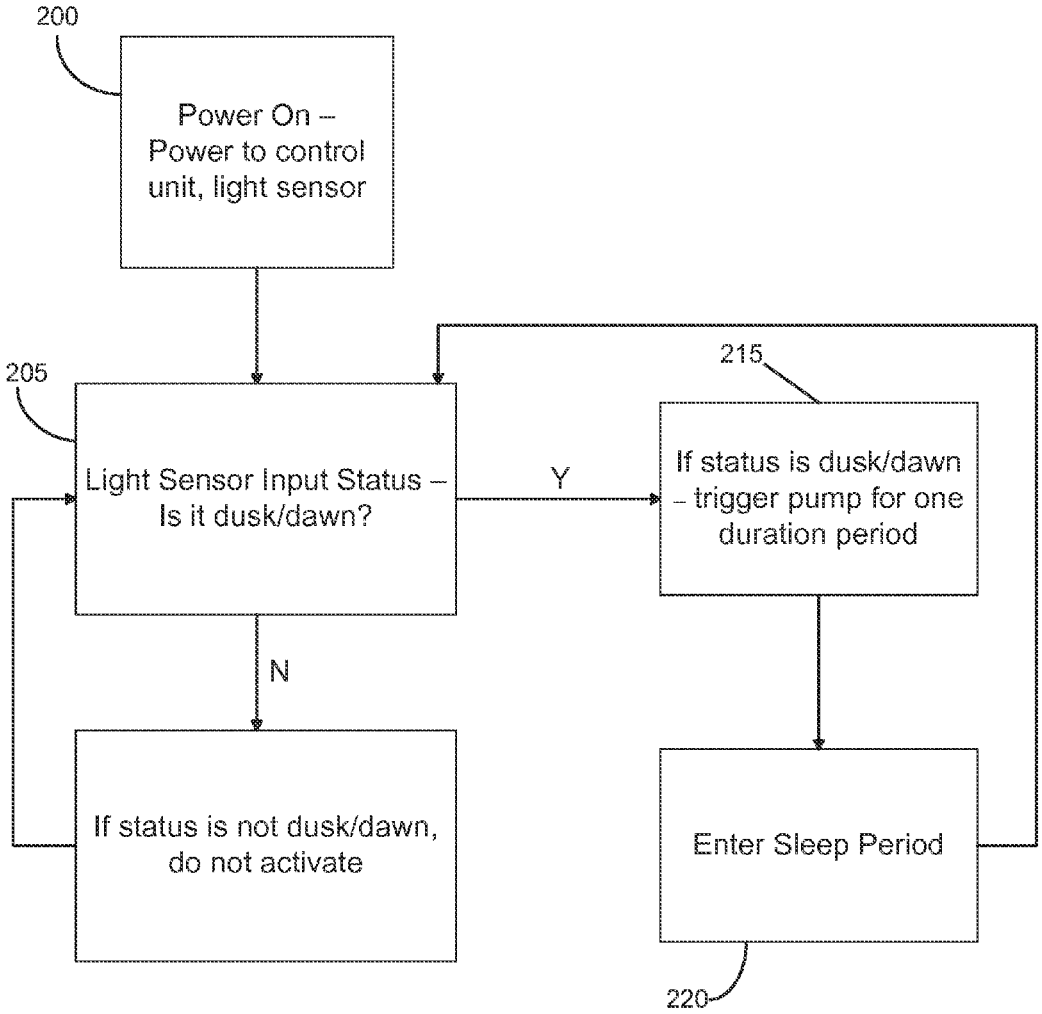
FIG. 4 is a operational flow diagram of a fluid delivery device in accordance with one embodiment.

FIG. 4 shows a functional or operational method of using the device of the present invention, according to one embodiment. In a first stage (block 200), the device is "powered on." Powering the device may be accomplished by, for example, manually actuating a power switch. In the first stage (block 200), power is provided to the electronic control unit 18 and ambient light sensor 40.

In a second stage (block 205), the electronic control unit 18 compares the signal being received from the ambient light sensor 40 to the predetermined trigger values consistent with "dusk" and "dawn" ambient light conditions. If the signal being received from the ambient light sensor 40 is not within the dusk/dawn range, the device is not activated (block 210). If the signal being received from the ambient light sensor 40 is within the dusk/dawn range, the device dispenses fluid for an appropriate duration period (block 215). In one embodiment, the duration period may range between about 10 seconds and 5 hours, although it will be appreciated that duration periods of a higher or lower magnitude may be employed in the operation of device 10. Optionally, in another embodiment, a manual override switch is provided for manually starting the dispensing of fluid at a time other than as determined by the signal being received from ambient light sensor 40.

After expiration of the duration period, in some embodiments, the device 10 enters a sleep period of appropriate duration (block 220). In one embodiment, the sleep period may range between about 1 minute and 10 hours. In a further embodiment, the sleep period may be about 5 hours. Upon expiration of the sleep period, the electronic control unit 18 again compares the signal being received from the ambient light sensor 40 to the predetermined trigger values consistent with "dusk" and "dawn" ambient light conditions (block 205).

While the foregoing method initiates dispensing of fluid during "dusk" and "dawn" ambient light conditions, the present invention anticipates the electronic control unit 18 being additionally programmed to allow for dispensing of treating fluid at ambient light conditions consistent with any selected time of day, such as for example, midday.

With regard to fastening, mounting, attaching or connecting components of the present invention to form the device or apparatus as a whole, or to form components, unless specifically described as otherwise, conventional fasteners such as machine screws, rivets, nuts and bolts, toggles, pins and the like may be used. Other fastening or attachment devices, substances and methods appropriate for connecting or making the invention and/or components thereof include friction fitting, adhesives, welding and soldering, the latter particularly with regard to the electrical system. Components of the electrical system and/or wiring of the present invention may be selected from commercially available components unless otherwise indicated, including electrical components and circuitry, wires, fuses, soldered connections, display components, microprocessors, chips, boards and control system components. Generally, unless specifically otherwise disclosed or taught, the materials for making the various components of the present invention and/or the invention as a whole are selected from appropriate materials such as metal, metallic alloys, ceramics, plastics, fiberglass and the like.

Embodiments of the present invention, including preferred embodiments, have been presented for the purpose of illustration and description. They are not intended to be exhaustive or to limit the invention to the precise forms and steps disclosed. Obvious modifications or variations are possible in light of the above teachings. The embodiments were chosen and described to provide the best illustration of the principles of the invention and the practical application thereof, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A fluid delivery device comprising:

a fluid reservoir;

a pump in fluid communication with the reservoir, said pump driven by an electric motor;

a bladder in fluid communication with the pump, said bladder comprising at least in part, an elastic portion, wherein the pump feeds the fluid into the bladder;

a nozzle valve in fluid communication with the bladder, wherein the nozzle may be adjusted from an open mode to a closed mode, and from a closed mode to an open mode;

a pressure release valve in fluid communication with the bladder and the fluid reservoir; and an electronic control unit for controlling delivery of the fluid.

2. The device of claim 1, wherein the fluid is delivered in a fine mist.

3. The device of claim 2, wherein the fine mist comprises a plurality of droplets having a diameter of less than about 50 microns.

4. The device of claim 2, wherein the fluid comprises a diluted aqueous solution of at least one of an insecticide, pesticide, or fungicide.

5. The device of claim 1, wherein the nozzle comprises a rotatable valve member for adjusting the nozzle from the open mode to the closed mode, and from the closed mode to the open mode.

6. The device of claim 5, wherein said rotatable valve member is operatively connected to an electric motor.

7. The device of claim 1, wherein the pressure release valve is coupled to the bladder and comprises a valve which provides for one-directional flow of fluid after a selected upstream pressure has been achieved.

8. The device of claim 1, wherein the device is configured to be received by a housing.

9. The device of claim 8, wherein the housing comprises an outdoor lighting source.

10. The device of claim 1, wherein the pressure release valve is located in a conduit between the bladder and the fluid reservoir.

11. The device of claim 1, further comprising:

an ambient light sensor which generates and feeds an electric signal to the electronic control unit.

12. The device of claim 1, further comprising:

an agitator in fluid communication with the bladder and the nozzle valve.

13. A fluid delivery device comprising:

a fluid reservoir;

a means for pumping fluid, wherein the pumping means is in fluid communication with the reservoir, and wherein the pumping means is driven by an electric motor;

a bladder in fluid communication with the pumping means, said bladder comprising at least in part, an elastic portion, wherein the pumping means feeds the fluid into the bladder;

a nozzle valve in fluid communication with the bladder, wherein the nozzle may be adjusted from an open mode to a closed mode, and from a closed mode to an open mode;

a pressure release valve in fluid communication with the bladder and the fluid reservoir; and an electronic control unit for controlling delivery of the fluid.

14. The device of claim 13, wherein the pressure release valve is located in a conduit between the bladder and the fluid reservoir.

15. The device of claim 13, further comprising:

an ambient light sensor which generates and feeds an electric signal to the electronic control unit.

* * * * *